US007891155B2

(12) United States Patent
Surowiecki

(10) Patent No.: US 7,891,155 B2
(45) Date of Patent: Feb. 22, 2011

(54) SHEET METAL HEADER BEAM

(76) Inventor: Matt F. Surowiecki, 10023 Martin Luther King Jr. Way, Seattle, WA (US) 98178

( * ) Notice: Subject to any disclaimer, the term of this patent is extended or adjusted under 35 U.S.C. 154(b) by 780 days.

(21) Appl. No.: 11/706,646

(22) Filed: Feb. 15, 2007

(65) Prior Publication Data

US 2008/0196332 A1 Aug. 21, 2008

(51) Int. Cl.
*E04C 3/00* (2006.01)

(52) U.S. Cl. ..... 52/842; 52/241; 52/650.1; 29/897.35

(58) Field of Classification Search ..... 52/842, 52/843, 846, 204.2, 241, 650.1, 837, 831, 52/836, 786.13; 29/897.35; D25/126
See application file for complete search history.

(56) References Cited

U.S. PATENT DOCUMENTS

| | | | | | |
|---|---|---|---|---|---|
| 991,603 | A * | 5/1911 | Brooks | 52/364 |
| 2,384,849 | A * | 9/1945 | Bowen et al. | 52/377 |
| 3,256,670 | A * | 6/1966 | Tersigni | 52/634 |
| 3,698,224 | A * | 10/1972 | Saytes | 72/178 |
| 4,850,175 | A * | 7/1989 | Berdan | 52/786.13 |
| 5,377,473 | A * | 1/1995 | Narayan et al. | 52/786.13 |
| 5,535,569 | A * | 7/1996 | Seccombe et al. | 52/634 |
| 5,577,796 | A * | 11/1996 | Clausen | 296/202 |
| 5,679,419 | A * | 10/1997 | Larsen | 428/34 |
| 5,930,963 | A * | 8/1999 | Nichols | 52/239 |
| 6,115,986 | A * | 9/2000 | Kelly | 52/481.1 |
| 6,131,362 | A * | 10/2000 | Buecker | 52/842 |
| 6,141,935 | A * | 11/2000 | Artner et al. | 52/843 |
| 6,436,552 | B1 * | 8/2002 | Walker et al. | 428/598 |
| 6,684,505 | B2 * | 2/2004 | Sundgren et al. | 29/897.2 |
| 6,748,705 | B2 * | 6/2004 | Orszulak et al. | 52/167.1 |
| 7,007,989 | B2 * | 3/2006 | Yoon | 293/120 |
| 7,076,927 | B2 * | 7/2006 | Trpkovski | 52/204.5 |
| 7,407,219 | B2 * | 8/2008 | Glasgow et al. | 296/187.03 |
| 7,503,601 | B2 * | 3/2009 | Agrahari | 293/102 |
| 2004/0035065 | A1 * | 2/2004 | Orszulak et al. | 52/167.1 |
| 2005/0213478 | A1 * | 9/2005 | Glasgow et al. | 369/262 |
| 2005/0241258 | A1 * | 11/2005 | Shih | 52/647 |

FOREIGN PATENT DOCUMENTS

| | | | |
|---|---|---|---|
| EP | 267843 | A1 * | 5/1988 |
| GB | 2235712 | A * | 3/1991 |

* cited by examiner

*Primary Examiner*—Robert J Canfield
*Assistant Examiner*—Brent W Herring
(74) *Attorney, Agent, or Firm*—Bruce A. Kaser

(57) ABSTRACT

A sheet-metal header beam is constructed from a single sheet of sheet metal (10). It is folded to form an upper channel (58) having a bottom wall (12) and inner sidewalls (14, 16). The upper boundaries of the sidewalls (14, 16) form corners (24, 28) with top walls (30, 32) which in turn form corners (26, 28) with outside walls (38, 40). Lower portions of the outside walls (30, 40) and regions (50, 52) form sidewalls of a lower channel (60). Regions (50, 52) are bent at corners (42, 44) to form flanges (46, 48) which form a top for the lower channel (60).

5 Claims, 5 Drawing Sheets

SHEET METAL HEADER BEAM

TECHNICAL FIELD

The present invention relates to a sheet metal header beam and, in particular, to a sheet metal header beam that is constructed from a one-piece sheet metal member and which is characterized by an upwardly opening upper channel formed between box beam sections and by a downwardly opening lower channel.

BACKGROUND OF THE INVENTION

A "header" is a beam that is used on top of a door or window opening. It is constructed to carry relatively large loads without bending. In wood framing construction, the header is generally a wood beam that is deeper than it is wide and substantially as wide as the wood studs that are used to form the framing wall that includes the door or window opening.

In sheet metal wall construction, it is known to form a header from a pair of sheet metal beams that are bolted together. An example of this construction is disclosed by FIG. 6 of U.S. Pat. No. 6,131,362, granted Oct. 17, 2000, to Robert V. Buecker.

There is a need for a sheet metal header that can be constructed fast and easy from a single sheet-metal member. The principal object of the present invention is to fill this need.

It is also an object of the invention to provide a sheet metal header that is in the nature of a box beam having a downwardly opening lower channel portion sized to receive upper end portions of a pair of studs that define the sides of the window or door opening.

BRIEF SUMMARY OF THE INVENTION

In preferred form, the sheet metal header beam of the present invention includes a pair of laterally spaced apart top walls, each having an inner edge boundary and an outer edge boundary. A pair of laterally spaced apart upper channel sidewalls extend downwardly from the inner edge boundaries of the top walls to laterally spaced apart lower edge boundaries. An upper channel bottom wall extends between and interconnects the lower edge boundaries of the upper channel sidewalls. A pair of laterally spaced apart outside walls extend downwardly from the outer edge boundaries of the top walls, each to a fold. A pair of lower channel sidewalls extend upwardly from the folds to upper corners. A pair of flanges extend laterally inwardly from the upper corners to form a top for the lower channel. This top is positioned below the bottom of the upper channel. The flanges have inner edges which substantially meet each other below the bottom wall of the upper channel.

This sheet metal header beam is constructed from a single sheet metal member that is bent at the corners between the flanges and the inside sidewalls of the lower channel, at the folds, at the upper corners where the outside walls meet the outer boundaries of the top walls, at the corners where the inner boundaries of the top walls meet the upper boundaries of the inside walls, and at the corners where the lower boundaries of the upper channel sidewalls meet the bottom of the upper channel.

Additional objects, advantages and features of the invention will become apparent from the description set forth below, from the drawings, and from the principles that are embodied in the specific structures that are illustrated and described.

Preferably, the top walls are in substantially co-planar parallelism. The upper channel sidewalls may diverge apart as they extend upwardly from the upper channel bottom wall.

Preferably also, the outside walls of the header beam are substantially parallel and the lower channel sidewalls are substantially parallel. The lower flanges that form the top of the lower channel are preferably substantially in co-planar parallelism.

BRIEF DESCRIPTION OF THE SEVERAL VIEWS OF THE DRAWINGS

Like reference numerals refer to like parts throughout the several views of the drawing, and.

DETAILED DESCRIPTION OF THE ILLUSTRATED EMBODIMENT

Figure 1:
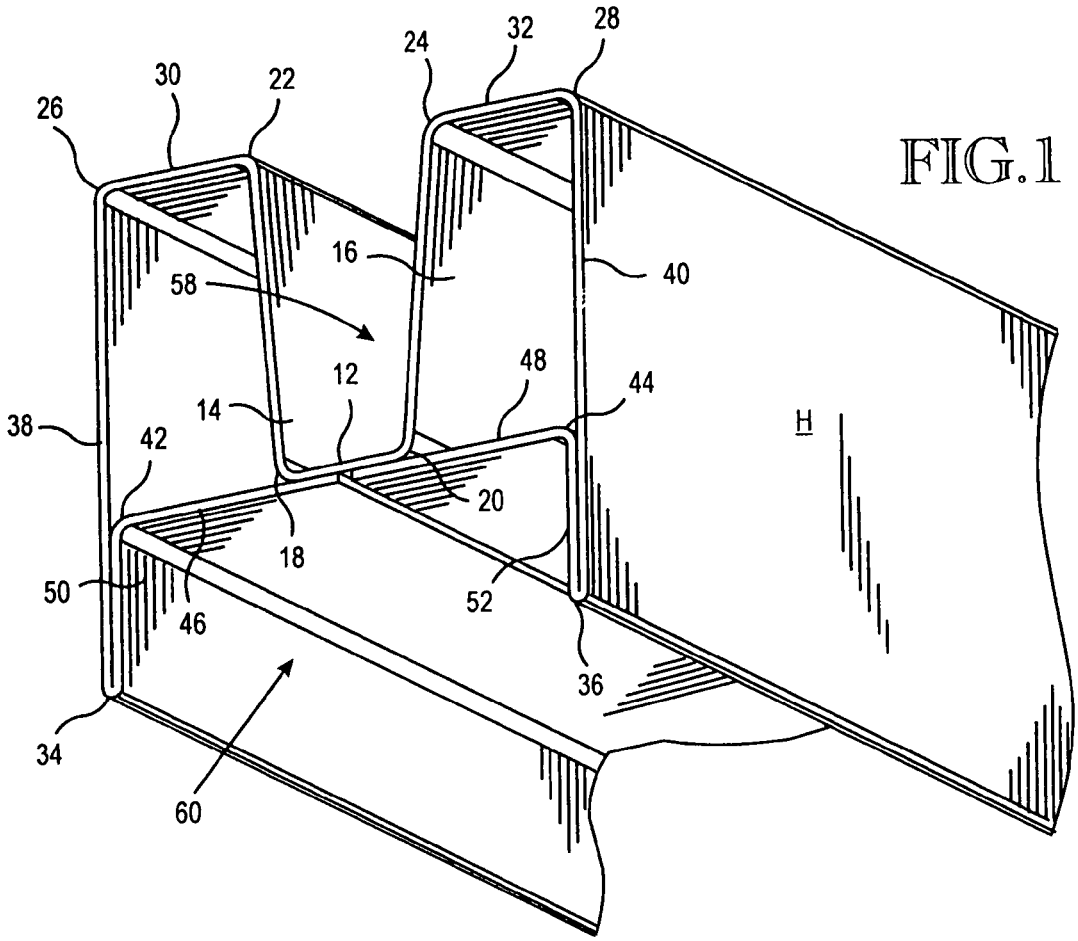
FIG. 1 is a fragmentary pictorial view of an end portion of a header that embodies the present invention, such view being taken from below and looking towards one end, the bottom and one side of the header.

FIG. 1 is a pictorial view of an end portion of a header that embodies the present invention. The header H can be adapted for use over either a door opening or a window opening. The width of the header H substantially corresponds to the depth dimension of the studs and tracks used to form the framing wall. The height of the header H is determined by the loads that will be imposed on the header as it expands across the top of the door or window opening.

Figure 2:
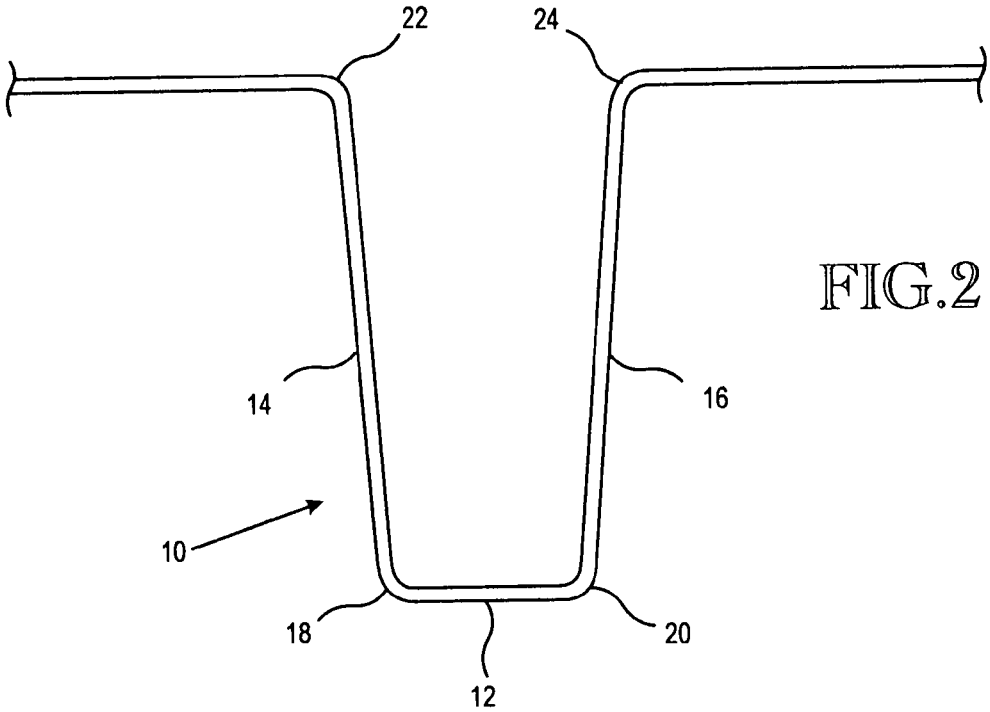
FIG. 2 is a fragmentary end view showing the beginning stages of bending a single sheet metal member to form the header beam shown by FIG. 1, such view showing a central portion of the member, with side portions omitted.

FIG. 2 is an end view of a center portion of a sheet metal member 10 that has been bent to form a bottom wall 12 and sidewalls 14, 16 of an upper channel. Bends or folds 18, 20 are formed where the bottom wall 12 meets the lower edge boundaries of the upper channel sidewalls 14, 16. Folds or bends 22, 24 are formed at the upper boundaries of the upper channel sidewalls 14, 16.

Figure 3:
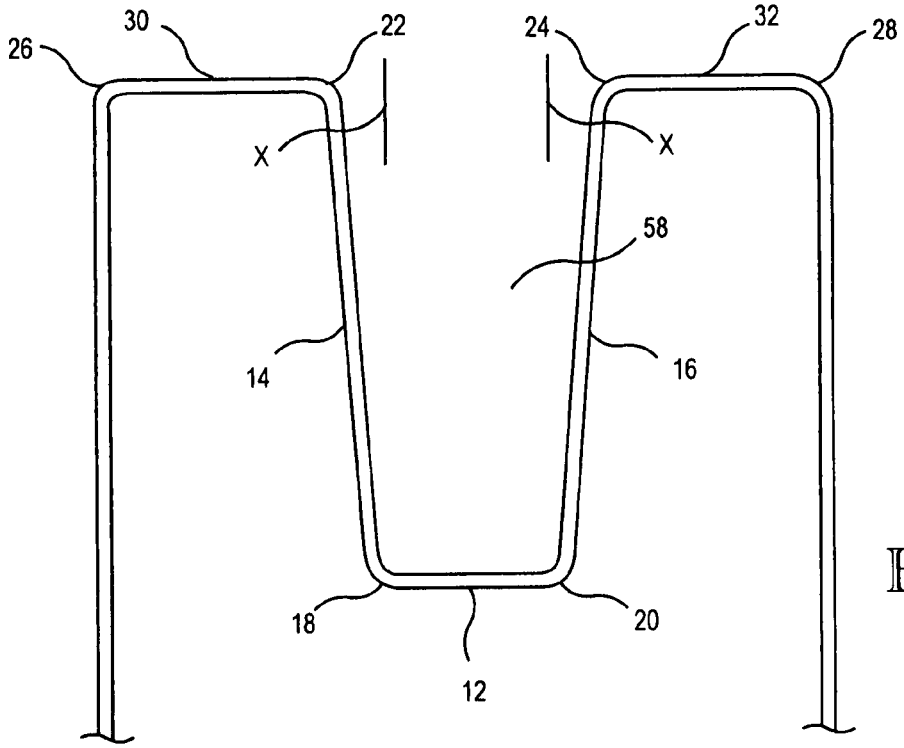
FIG. 3 is a view like FIG. 2, but showing a little more of the sheet metal member and another step in the formation of the header.

Referring to FIG. 3, the side parts of the sheet metal member 10 are again bent or folded at corners 26, 28. This forms a pair of co-planar, laterally spaced apart top walls 30, 32. The bends or folds 26, 28 are substantially ninety degrees (90°) so that the side portions 38, 40 of the member 10 now extend downwardly in spaced apart parallelism.

Next, bends or folds 34, 36 are made and this defines the height of the header. Vertically, the header extends upwardly from the corners 34, 36 to the corners 26, 28. At this point the width of the header is established. It is the horizontal distance between the outside surfaces of outside walls 38, 40.

The next bends or folds are made at 42, 44. At the time shown by FIG. 4, the remaining portions 46, 48 of the sheet metal member 10 extend downwardly from the corners 42, 44. This forms region 50 between corner 34 and corner 42 and region 52 between corner 36 and corner 44.

Figure 5:
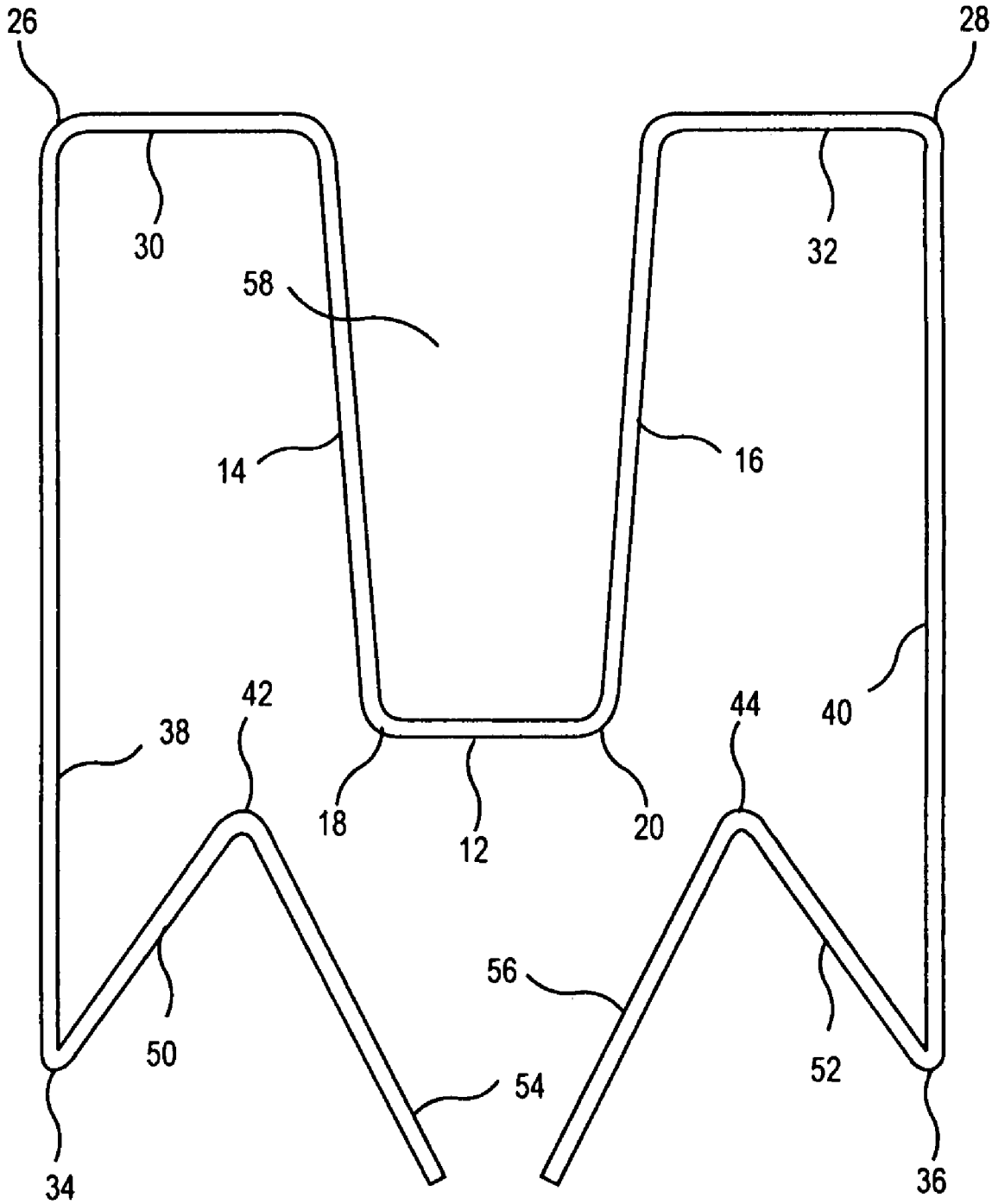
FIG. 5 is a view like FIGS. 2-4, but showing the sheet metal member in the final stages of bending.

Referring now to FIG. 5, the header is completed by swinging region 50 towards wall 38 and region 52 towards wall 40. At the same time, or immediately thereafter, the regions 54, 56 are swung upwardly and eventually substantially against bottom wall 12 of the upper channel. This position is shown by FIG. 1.

When the sheet metal member 10 is bent in the manner described, a header beam H is formed that comprises an upwardly opening channel 58 and a downwardly opening channel 60. When the beam H is complete, the flanges 54, 56 are in co-planar parallelism immediately below the bottom wall 12 of the upper channel 58. The regions 50, 52 fold against the sidewalls 38, 40 and form sidewalls 38, 50 and 40, 52 for the lower channel 60. The flanges 54, 56 form a top for the lower channel 60 that is positioned immediately below the bottom 12 of the upper channel 58. Accordingly, the sheet-metal header beam H is constructed from a single sheet metal member 10 that is bent at the corners between the flanges 54, 56 and the inside sidewalls 50, 52 of the lower channel 60, at the folds 34, 36, at the upper corners 26, 28 where the outer sidewalls 38, 40 meet the top walls 30, 32, at the corners 22, 24 where the top walls 30, 32 meet the inside walls 14, 16 of the upper channel 58, and at the corners 18, 20 where the lower edge boundaries of the sidewalls 14, 16 meet the side boundaries of the bottom wall 12.

The upper end portions of studs 60, 62 which form the side boundaries of the window or door opening 64 fit into an upper channel or track. The inside width of the upper and lower channels 60, 62 is substantially equal to the outside width of the studs S.

Figure 4:
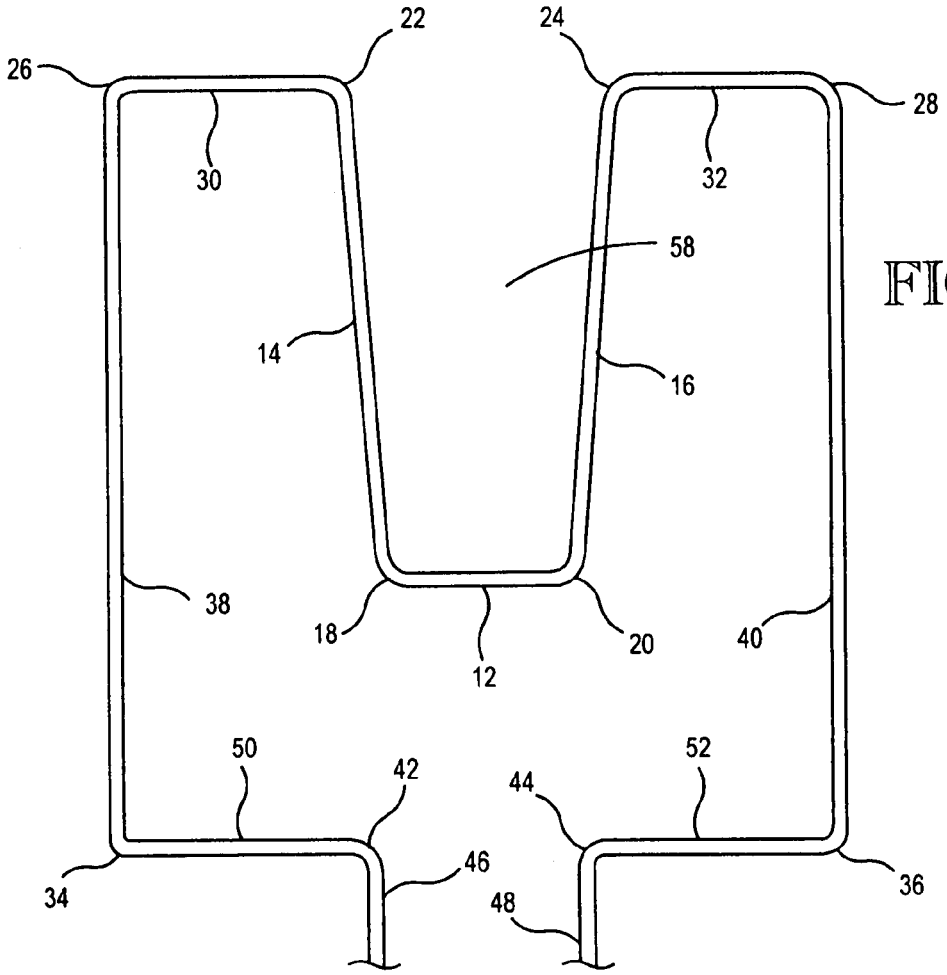
FIG. 4 is a view like FIGS. 2 and 3, but showing another step in the formation of the header.

As clearly shown by FIGS. 1 and 3-4, the top walls 30, 32 of header H are substantially in co-planar parallelism. The upper channel sidewalls 14, 16 diverge apart as they extend upwardly from the upper channel bottom wall to the corners 22, 24. By way of example, the angles X (FIG. 3) may be between five and eight degrees (5°-8°).

As also shown by FIGS. 1 and 3-4, the outside walls 38, 40 are substantially parallel to each other. The lower channel sidewalls 38, 50 and 40, 52 are substantially parallel. The flanges 46, 48 are in substantially co-planar parallelism.

Figure 6:
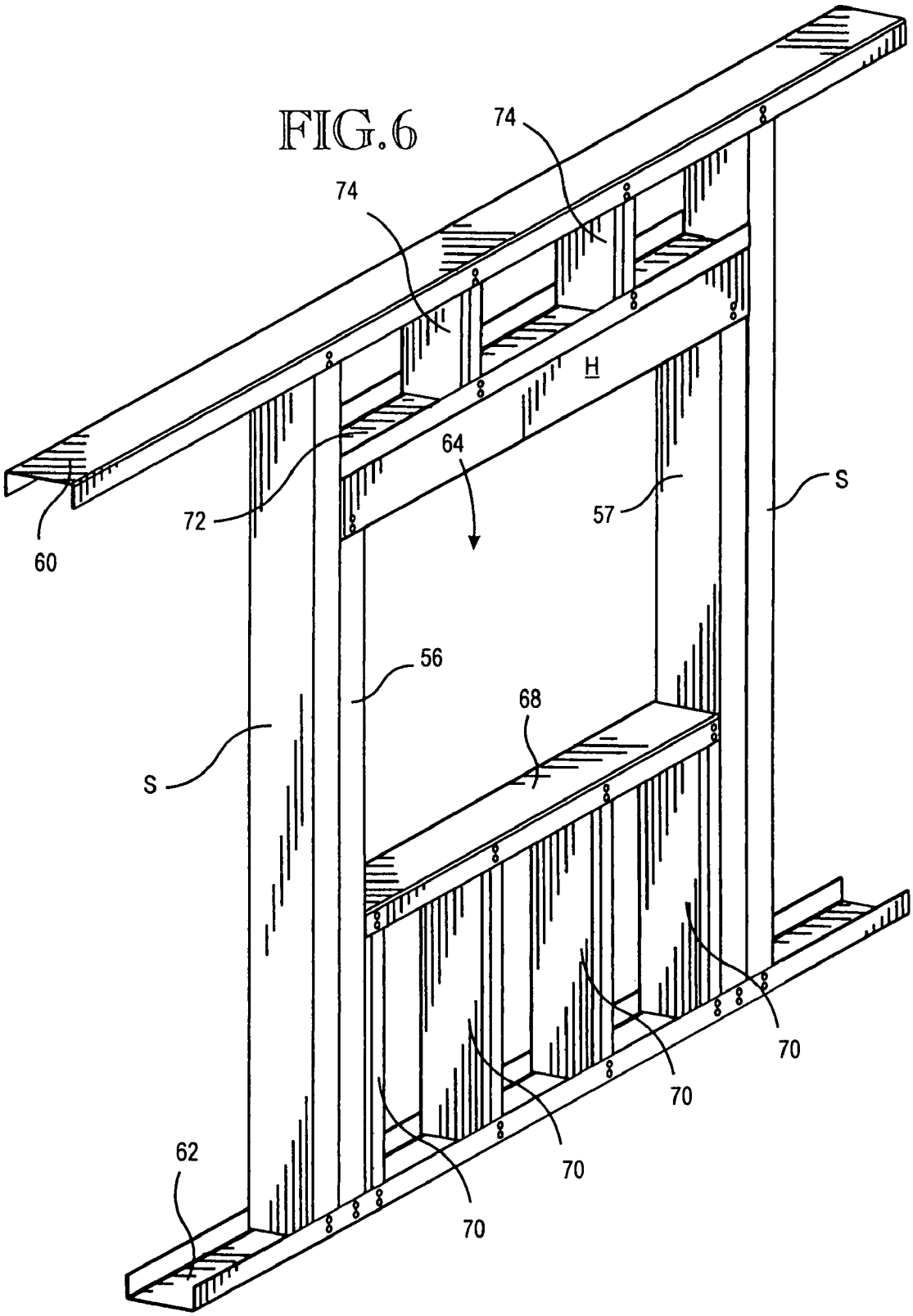
FIG. 6 is a fragmentary pictorial view of a window region in a framing wall, showing a header of the invention positioned above a window opening in the wall.
Figure 7:
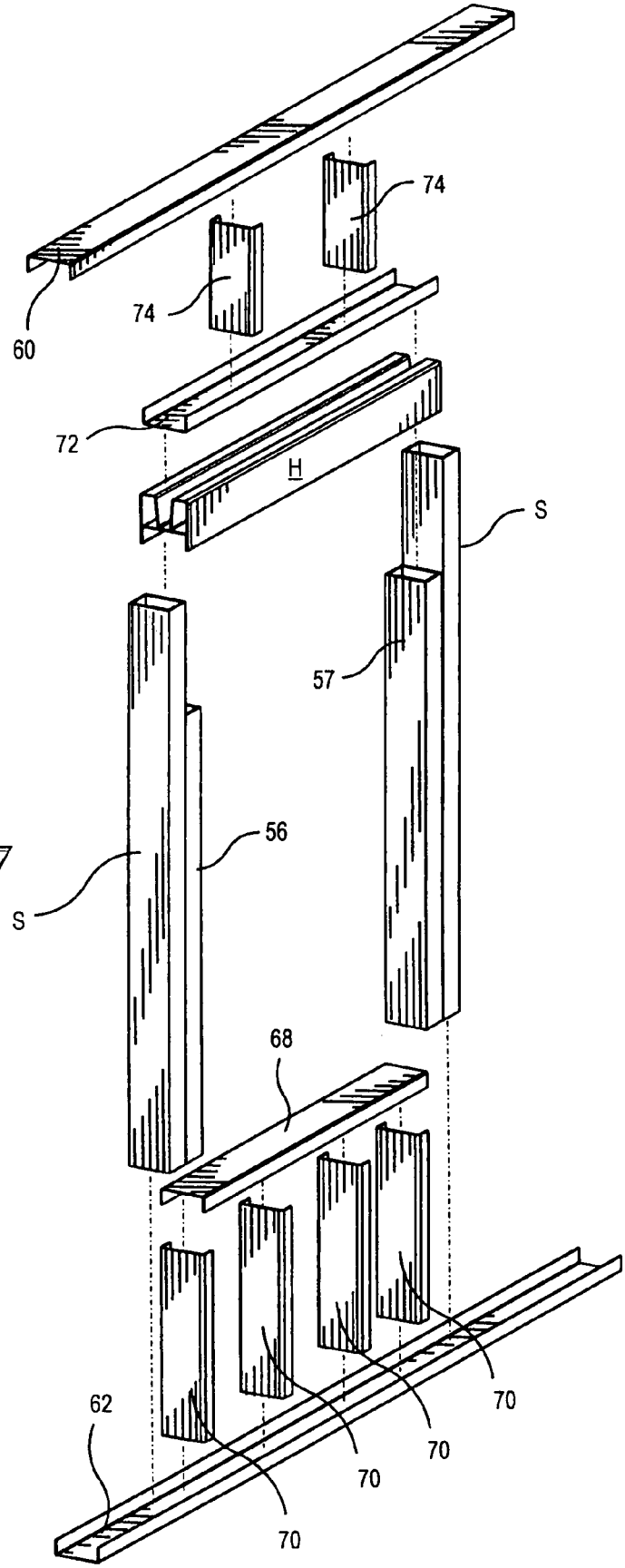
FIG. 7 is an exploded pictorial view of the assembly shown by FIG. 6.

FIGS. 6 and 7 show a typical installation of a header beam H. A portion of a framing wall is shown which includes upper and lower channels 60, 62 and studs S. Where a window opening 64 is formed, a header H extends horizontally between two full length studs S. The ends of the header H receive the upper end portions of shorter studs 56, 58. The window opening 64 includes a sill 68 and short studs 70 below the sill 68. A channel 72 may be placed on the top of the header H. This allows short studs 74 to be placed between the channels 60, 72 above the header H.

The illustrated embodiment forms an example of the present invention and, therefore, is non-limitive. It is to be understood that many changes to the particular structure, materials and features of the invention may be made without departing from the spirit and scope of the invention. Therefore, it is my intention that my patent rights not be limited by the particular embodiment that is illustrated and described herein, but rather are to be determined by the following claims, interpreted according to accepted doctrines of patent claim interpretation, including use of the doctrine of equivalents.

What is claimed is:

1. An elongated sheet metal header beam, comprising:

a pair of co-planar, laterally spaced apart top walls, each having an inner edge boundary and an outer edge boundary spaced from the inner edge boundary;

a pair of laterally spaced apart upper channel side walls, extending downwardly from the inner edge boundaries of the top walls to laterally spaced apart lower edge boundaries;

an upper channel bottom wall extending between and interconnecting the lower edge boundaries of the upper channel side walls;

a pair of laterally spaced apart outside walls extending downwardly from the outer edge boundaries of the top walls, each to a substantially 180-degree fold;

a pair of lower channel sidewalls, each extending upwardly from a said fold to an upper corner;

a pair of flanges extending laterally inwardly from each respective upper corner to form a pair of top walls for the lower channel that is positioned below the bottom of the upper channel, said flanges having inner edges which substantially meet each other below the bottom wall of the upper channel, and said flanges contacting said upper channel bottom wall; and wherein the sheet-metal header beam is constructed from a single sheet metal member that is bent at the corners between the flanges and the inside sidewalls of the lower channel, at the folds, at the upper corners where the outside walls meet the outer boundaries of the top walls, where the inner boundaries of the top walls meet the upper boundaries of the inside walls, and where the lower boundaries of the upper channel side walls meet the bottom of the upper channel.

2. The sheet-metal header beam of claim 1, wherein the top walls are substantially in co-planar parallelism.

3. The sheet-metal header beam of claim 2, wherein the flanges are in substantially co-planar parallelism.

4. The sheet-metal header of claim 2, wherein the outside walls of the beam are substantially parallel.

5. The sheet-metal header beam of claim 1, wherein said pair of lower channel sidewalls are substantially parallel.

* * * * *